US008183447B1

(12) United States Patent
Chapman

(10) Patent No.: US 8,183,447 B1
(45) Date of Patent: May 22, 2012

(54) DUAL-TENSIONED NECK TRUSS SYSTEM FOR STRINGED MUSICAL INSTRUMENTS

(76) Inventor: Emmett E. Chapman, Woodland Hills, CA (US)

( * ) Notice: Subject to any disclaimer, the term of this patent is extended or adjusted under 35 U.S.C. 154(b) by 0 days.

(21) Appl. No.: 12/817,078

(22) Filed: Jun. 16, 2010

(51) Int. Cl.
*G10D 3/00* (2006.01)

(52) U.S. Cl. ..... 84/293

(58) Field of Classification Search ..... 84/267, 84/290, 293
See application file for complete search history.

(56) References Cited

U.S. PATENT DOCUMENTS

| | | | | |
|---|---|---|---|---|
| 3,833,751 | A | 9/1974 | Chapman | |
| 3,868,880 | A | 3/1975 | Chapman | |
| 4,557,174 | A | 12/1985 | Gressett, Jr. | |
| 4,953,435 | A | 9/1990 | Chapman | |
| 5,232,192 | A | 8/1993 | Akutagawa | |
| 5,864,073 | A | 1/1999 | Carlson | |
| 6,051,765 | A | 4/2000 | Regenberg et al. | |
| 6,100,458 | A * | 8/2000 | Carrington et al. | 84/293 |
| 7,629,521 | B1 | 12/2009 | Chapman | |
| 2005/0252152 | A1 * | 11/2005 | Belinda et al. | 52/690 |

* cited by examiner

*Primary Examiner* — Kimberly Lockett
(74) *Attorney, Agent, or Firm* — J. E. McTaggart

(57) ABSTRACT

A dual-inline neck truss system in a stringed musical instrument is disposed uniformly along the instrument neck, generally toward the rear side, opposite the front side that forms or supports a fingerboard or fret-board. The truss system may be a two-portion single member or two separate in-line members, and is enclosed close to the rear surface of the neck or else with a surface exposed along its full length and made flush with the rear neck surface, smooth to the touch. The truss system is secured to the neck at a designated intermediate location so as to form two substantially co-linear truss portions, either of which can be adjusted for tension independently via manual adjustment hardware for applying pressure against opposite end regions of the neck, thus enabling special desired instrument setup for optimal string-to-fretboard/fingerboard spacing, e.g. providing optimal low "action" with "relief" in the form of special concave curvature contour in a low pitched portion of the neck, particularly advantageous for instruments such as The Stick®, which is designed to be played with two-handed string-tapping technique.

14 Claims, 4 Drawing Sheets

DUAL-TENSIONED NECK TRUSS SYSTEM FOR STRINGED MUSICAL INSTRUMENTS

FIELD OF THE INVENTION

The present invention relates to stringed musical instruments generally of the guitar family, and more particularly to a dual in-line truss system in a stringed instrument neck supporting a fretboard or fretless fingerboard, that enables independent curvature adjustment in two different portions of the neck to attain low fingering "action" and "relief" accomplished by specialized contour patterns providing desired string clearances along the fretboard/fingerboard.

BACKGROUND OF THE INVENTION

In stringed musical instruments such as guitars and bass guitars, a main component is the neck that provides or supports a fretboard or fretless fingerboard. The neck is typically made from wood and is ordinarily designed to be nominally flat along its length. When the instrument is strung and tuned, the high tension in the strings, in the order of one or two hundred pounds, sets up a strong continuous compressive stress in the neck that is unbalanced front-to-back in the direction that tends to bow the neck and cause concave curvature in an initially straight fingerboard.

The amount of concave curvature that occurs in the setup of a new neck depends on the strength of the neck material, and tends to increase over time due to the constant string tension and resulting neck pressure that is unbalanced front-to-back and is thus likely to cause neck bowing and concave curvature to an extent that makes the instrument difficult to play due to excessive string-to-fret separation along at least some portion of the fingerboard, known as high "action", requiring excessive fingering force and string displacement in the player's technique.

In initial setup or refurbishing of a stringed musical instrument, the overall action is set by adjusting the height of the string-end support points, i.e. at the "bridge" and at the "nut" of the instrument. If the instrument has the conventional tension-adjustable truss member (commonly referred to a "truss rod" although it can be made with different cross-sectional shapes other than circular, e.g. rectangular, square, etc.), it can be tightened to counteract concave neck curvature, with maximum effect on the action height in the mid region of the fretboard/fingerboard length, so that, along with action height adjustment at the bridge and nut, this conventional instrument set-up system enables the action to be set up to optimize string-to-fret separation in three longitudinal regions of the fretboard/fingerboard: the two end regions and a mid-region.

In setting up high quality fretted stringed instruments, after the initial three point setup described above, any remaining anomalies in the action, e.g. between the three points, are usually subject to corrective work by the technician or luthier "dressing" and "crowning" the frets in the fretboard, i.e filing metal material from the fret tips and then re-rounding the fret tips.

While, historically, the foregoing setup procedure, i.e. three-point spacing adjustment plus dressing of individual frets, has worked tolerably well overall for the great majority of guitar-like stringed instruments, some new necks and many seasoned necks exhibit curvature patterns, such as non-symmetrical concave neck curvature that severely compromises proper setup with the available adjustment mechanisms. Even with a skilled technician or luthier, the work required often proves tedious and costly, or even impossible.

Furthermore, some types of high end stringed instruments such as the Chapman Stick (registered trademark), which is played by a unique variation of two-handed string tapping first discovered and taught by the present inventor, benefit particularly from very low "action" all along the frets as well as from moderate "relief" at the lower pitched frets. There is an unfulfilled need in the stringed instrument marketplace for a more versatile truss system that provides a degree of setup capability that goes beyond that of the usual single truss, e.g. by providing additional regions of adjustment along the fretboard/fingerboard.

DISCUSSION OF KNOWN ART

U.S. Pat. No. 5,233,122 issued in 1993 to Kim for GUITAR WITH NECK TRUSS ROD SUPPORTING CONSTRUCTION discloses an extension member at one end of a rectangular metal truss rod anchored to a front board of the guitar body in a dovetail manner, exemplifying a type of truss system that attempts to prevent neck "cracking and bowing" by functioning strictly as a "brute-force" non-adjustable neck-stiffening beam element with no longitudinal stress applied. The truss member is entirely enclosed in the neck and is located immediately beneath the fretboard/fingerboard.

U.S. Pat. No. 5,864,073 for LAMINATED NECK FOR GUITARS AND COMBINATION THEREOF WITH ADJUSTMENT SYSTEM issued in 1999 to Carlson, assigned to Fender Musical Instrument Corporation, typifies traditional trussed stringed instrument neck construction of a type that has found wide usage in known art. A metal truss member is fully enclosed in the neck beneath the fretboard in an arched shape along a non-uniform groove of varying depth routed in the main neck portion and enclosed by a separate filler part beneath the truss member. This approach imposes burdens of structural complexity and adjustment difficulties, while exemplifying the widespread conventional practice of a truss member that acts in tension to counteract symmetric concave neck curvature.

In practice, fully enclosed truss members have proven somewhat troublesome regarding serviceability: if the threaded adjustment means on the truss member becomes stripped or the adjustment tool interface such as a screwdriver slot in the end of the truss member becomes deformed to a point of malfunction, removal of the truss member for repair or replacement is extremely difficult, e.g. requiring removal of the fretboard from the neck, and in some instances truss repair/adjustment may be practically impossible, rendering the instrument unrepairable.

U.S. Pat. No. 4,557,174 issued in 1985 to Gressett, Jr., assigned to Fender, discloses a GUITAR NECK INCORPORATING DOUBLE-ACTION TRUSS ROD APPARATUS, described as providing "compressive or tensile loading of the truss member for flexing of the neck in either direction". A sleeve 33, located in a central region of the truss rod for purposes of transmitting lateral thrust from the truss rod to the neck, is in "sliding metal-to-metal relationship with the truss member and thus fails to provide a longitudinally anchored point in the mid-region of the truss rod and thus fails to enable separate independent curvature correction adjustment of each half portion. Clearly this patent addresses only curvature that is generally symmetric over the full length of the neck.

U.S. Pat. No. 4,953,435 issued in 1990 to the present inventor, Emmett H. Chapman, for REAR-ACCESS TRUSSED NECK CONSTRUCTION FOR STRINGED MUSICAL INSTRUMENTS, discloses improved trussed neck structure that, as a fore-runner of the presently disclosed invention, has been incorporated as a refinement in the Chapman Stick (registered trademark) where uniform low action is desired to facilitate a special two-handed string-tapping playing technique (see U.S. Pat. Nos. 3,833,751, 3,868,880 and 4,953,435 by the present inventor). A substantially straight rigid truss member is disposed uniformly in a groove along the rear side of the neck such that a surface of the truss member is exposed along its full length, flush with the rear neck surface. A readily accessible rear-access threaded fabrication/service adjustment member provides convenient capability of applying an adjustable amount of either tension or compression as required to counteract unwanted neck-bending tendency in either direction, concave or convex, thus correcting and securing the neck in a straightened, stabilized condition.

U.S. Pat. No. 7,629,521, issued Dec. 8, 2009 to the present inventor, Emmett H. Chapman, for a DOUBLY ADJUSTABLE NECK TRUSS FOR STRINGED MUSICAL INSTRUMENTS, discloses improved trussed neck structure, capable of operation in tension or in compression, that was incorporated as a refinement in the Chapman Stick (registered trademark), where additional adjustment controls accomplish more uniform low action to facilitate special string-tapping techniques.

In some necks, particularly long necks, there may be unwanted curvature that, in the absence of compensation, is not uniformly distributed along the total length; instead it may be asymmetric, e.g. predominant in one or other half of the total neck length, so that it cannot be fully compensated by adjustment of the usual full-length truss member acting in tension. This four-way rigid truss structure provides ultimate versatility that enables each approximately half portion of the total neck length to be adjusted independently to work in tension or compression for correcting all profiles of neck curvature whether concave or convex, and whether symmetric or non-symmetric, to accomplish a desired optimal low "action" pattern with "relief".

U.S. Pat. No. 6,051,765, issued in 2000 to Regenberg et al for a GUITAR WITH CONTROLLED NECK FLEX, encloses the truss member in an inverted U-shaped channel member that fits into a U-shaped channel machined into the back of the fingerboard. First and second spacers are welded or otherwise fastened onto the truss member, separated from each other at predetermined locations along the truss member so as to divide the total truss member length into three regions with the two spacers, each acting in compression against the fingerboard to act on curvature. These "spacers" exert vertical pressure on the neck and fingerboard to create upward force at selected points along the board when the truss member is tightened in tension. Since the apparatus is buried within the neck under the laminated fingerboard, each spacer's location must be preset and the spacer welded or fastened to the truss member in a selected location in fabrication, after which the spacers cannot be adjusted or relocated to customize the truss action along the neck length. This approach of applying force from the truss member perpendicular to discrete points along the neck appears to be an adaptation of the concept of distributing compressive forces throughout the length of the neck (as in the curved truss disclosed in Fender U.S. Pat. No. 5,864,073 described above).

In the above-described and all other known prior art in neck trusses for stringed musical instruments, both in the usual tension type trusses for counteracting concave neck curvature and in unusual units that further provide the option of compression for counteracting convex neck curvature, these act over the full length of the neck, and as such, in a neck with compound or asymmetric curvature where the two portions of the neck require corrective compensation in different amounts, trusses of known prior art are inherently lacking in ability to be set up and adjusted in a manner to attain the ideal low "action" neck profile commonly sought by luthiers, i.e. providing "relief" with a predetermined concave contour in the lower pitched portion to minimize string buzzing on next-higher frets, along with a relatively straight profile for low "action" throughout the higher pitched portion.

OBJECTS OF THE INVENTION

A primary object of the present invention is to provide an improved trussed neck for stringed instruments, including adjustment means for counteracting initial concave neck bending in either or both of two fretboard/fingerboard portions within the full length of the neck, by independent adjustment of each truss portion to place it in a selected state of tension as required in order to set up the contour of each of the two neck portions independently so as to modify neck/fingerboard curvature in a manner to achieve a desired setup contour that requires only minimal subsequent dressing of frets to accomplish a desired final combination of straightness and concave curvature for optimal low "action" with "relief".

It is a further object to provide an embodiment wherein the truss system implementation allows the neck to be fabricated as a single piece of material, the front side serving directly as a playing surface thus eliminating any need for a separate fingerboard part, and the rear side containing the truss member exposed in a channel, thus facilitating truss/neck assembly and eliminating any need for additional neck parts such as cover or filler strips.

It is a still further object to provide an embodiment wherein the truss member can be readily removable for service and/or replacement without removing the fingerboard from the neck.

SUMMARY OF THE INVENTION

These and other objects and advantages have been accomplished in the dual in-line, dual-adjustable, tension-trussed neck system of the present invention which may be implemented either as two portions of a single full length truss member or as two separate in-line truss members. The truss system is disposed uniformly within the neck, preferably in a channel configured along the rear side of the neck. Functionally and structurally it is preferable to locate truss members maximally distal from the strings. In a flush embodiment, a flat surface of the truss member is exposed along its full length, flush with the rear neck surface and fitted closely in the channel so as to feel smooth to the touch. In an alternative enclosed truss embodiment, the truss member is located within the neck close to its rear surface, e.g. enclosed by a thin removable cover strip. The truss system is made adjustable in tension at both ends and is securely fastened to the neck at an intermediate fastening point so as to form two in-line truss portions, each of which can be adjusted manually for tension independent of the other, to apply localized pressure in the neck that alters neck curvature in a manner to attain a desired portion profile requirement. It is particularly desirable to accomplish the desired "relief" pattern of slightly concave curvature in the lower pitched neck portion along with a relatively flat contour for low "action" in the higher pitched neck portion.

A full understanding of this invention will be gained through a study of the accompanying drawings along with the following descriptive text.

BRIEF DESCRIPTION OF THE DRAWINGS

FIG. 5 illustrates typical concave curvature that is generally symmetric along the neck.

FIG. 6 illustrates asymmetric concave curvature, predominating in the left hand neck region.

FIG. 7 illustrates asymmetric concave curvature, predominating in the right hand neck region.

FIG. 8 illustrates a desired "relief" spacing pattern that can be attained by independent adjustment of each portion of the dual tensioned truss structure of present invention acting on initial concave conditions such as those shown in FIGS. 5-7.

DETAILED DESCRIPTION

Figure 1:
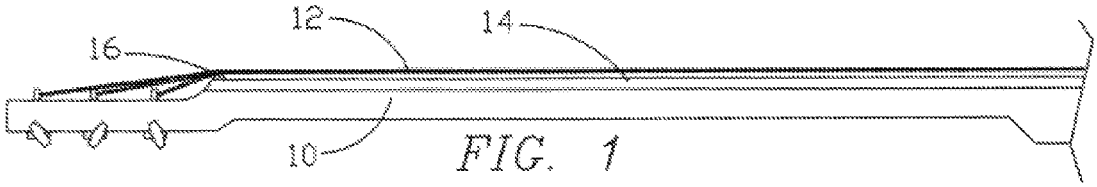
FIG. 1 PRIOR ART
FIG. 1 is a side view of a stringed musical instrument neck of a known non-truss type illustrating a flat fingerboard and a closely spaced parallel location of the strings.

FIG. 1 is a side view of a stringed musical instrument neck 10 and tuning headstock of a known art type that is made and used without a neck truss system. Taut strings 12 are supported so as to be spaced uniformly above the fingerboard 14, with string height provided at the left hand end by a string-supporting nut 16, and at the right hand end by a string-supporting bridge (not shown).

For simplicity, fingerboard 14 is shown as fretless, however the upper line of the fingerboard as shown also corresponds to a playing plane contour defined by the crowned tips of a set of frets of a fretted fingerboard, a.k.a. fret-board. It is generally desired for ease of playing that the playing plane be kept substantially straight longitudinally so that the nut 16 and bridge can hold the taut strings at a close spacing above the playing plane that is generally uniform throughout the neck length while sufficiently spaced to allow the strings to vibrate free from buzzing against next higher-pitched frets or the fingerboard 14. Such low "action" becomes especially important in various string-tapping techniques including the inventor's Free Hands two-handed string-tapping method created in 1969.

A fingerboard 14 can be made as an integral part of the neck, but more typically it is made as a separate thin layer of different material that is attached to the neck 10 and thus takes on the neck shape, which is important to players as they generally seek "low action" throughout the fretboard/fingerboard; otherwise it is more difficult to play since the player is forced to compensate and develop corrective fingering techniques.

Figure 2:
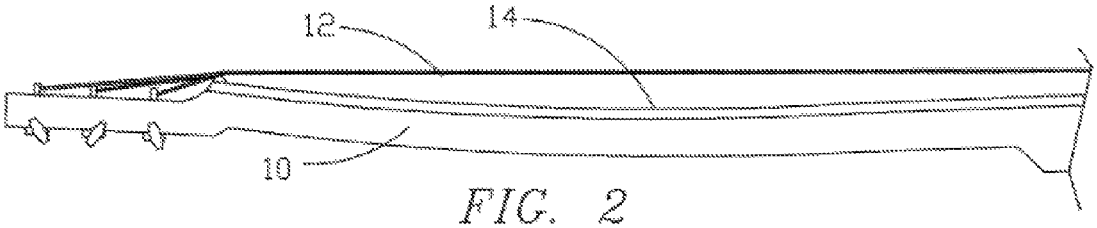
FIG. 2 PRIOR ART
FIG. 2 depicts the known instrument neck as in FIG. 1 showing an exaggerated condition of concave neck curvature.

FIG. 2 depicts an instrument neck 10 of the type depicted in FIG. 1, but wherein the neck 10 and fingerboard 14 are shown with typical curvature that is generally symmetrical throughout the length of the neck 10. The amount of curvature is shown exaggerated for clarity of illustration.

When the strings 12 are tensioned as required for tuning and playing purposes, tensile force, typically exceeding one hundred pounds, exerts compression on the neck with front-to-back unbalance that inherently tends to bend the neck and introduce concave curvature, a.k.a. "bowing". Even with optimal adjustment of the bridge support (located beyond the right hand end in FIG. 1), excessive concave neck curvature results in a compromise because of the increased sting spacing, i.e. high "action", in the mid-region of the fingerboard that cannot be corrected at the bridge and/or the nut.

Particularly if the neck 10 is made from wood, it is subject to both initial bowing and/or warping and, over time, to a variable amount of further bowing under the continuous stress in the instrument caused by string tension, leading to neck curvature to an extent that may make the instrument extremely difficult to play. This shortcoming of non-trussed instrument necks led to development and incorporation of various forms of truss structure for neck reinforcement and adjustment to counteract neck curvature.

Figure 3:
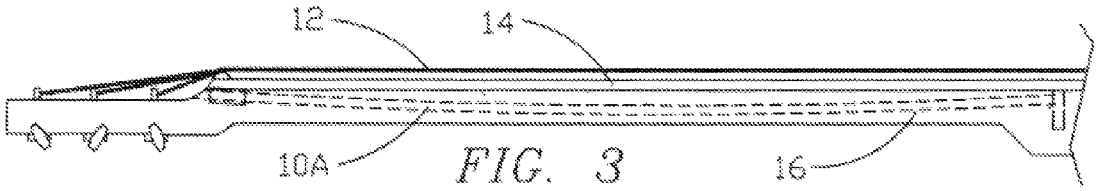
FIG. 3 PRIOR ART
FIG. 3 depicts an instrument neck of a known type wherein a curved truss member embedded in the neck acts in tension to counteract symmetrical concave neck curvature as shown in FIG. 2.

FIG. 3 depicts a stringed musical instrument neck and truss structure of a type disclosed in U.S. Pat. No. 5,864,073. A truss member 16 is embedded in neck 10A in the curved disposition shown and placed in adjustable tension to act on the neck in a manner to counteract concave neck curvature and attain desired low "action".

Figure 4:
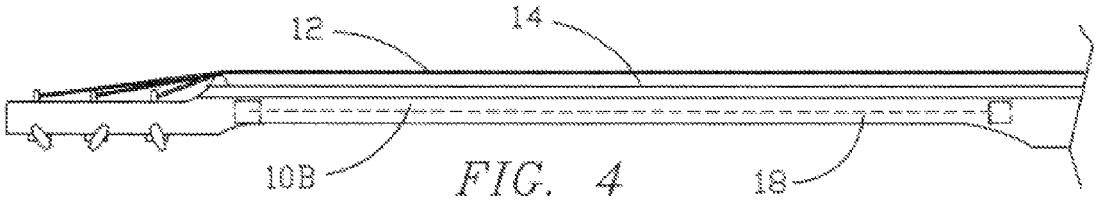
FIG. 4 PRIOR ART
FIG. 4 depicts an instrument neck of a known type, patented by the present inventor, containing a tensioned truss member, recessed along the bottom of the neck, that counteracts symmetrical concave neck curvature as shown in FIG. 2.

FIG. 4 depicts an instrument neck 10B of a known type, patented by the present inventor, containing a tensioned truss member 18, recessed along the bottom of the neck, and placed in tension that is readily adjustable by threaded hardware, typically located in a neck cavity of a truss adjustment structure at the body end, the opposite end of the truss member being anchored in a cavity near the nut end. Tightening the threaded hardware with a manual tool increases tension in truss member 18 and acts on neck 10B in a direction that counteracts concave neck curvature of the symmetric type shown in FIG. 2 and counteracts string tension.

FIGS. 5-8 illustrate different forms of concave neck curvature and corresponding patterns of "action", i.e. spacing between the taut strings and the effective underlying playing plane, whether it be that of a fretless fingerboard surface or that of the virtual (imaginary) plane of the fret crowns of a fretboard.

Figure 5:
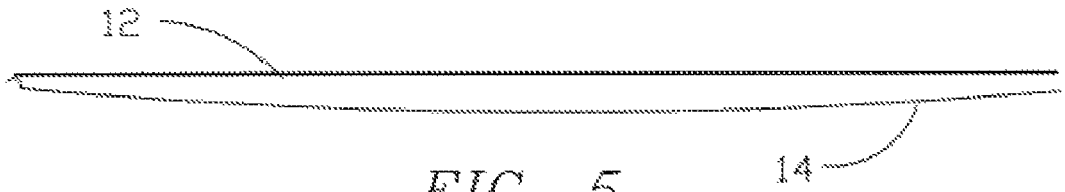
FIGS. 5-8 illustrate different forms of concave neck curvature and corresponding patterns of "action", i.e. spacing between the taut strings and the underlying contoured plane of a fretless fingerboard or virtual plane of the fret tips of a fretboard.

FIG. 5 illustrates typical concave curvature that is generally symmetric along the neck length as shown: the "action" height between the strings 12 and the fret contour of line 14 is greatest in the mid region.

Figure 6:
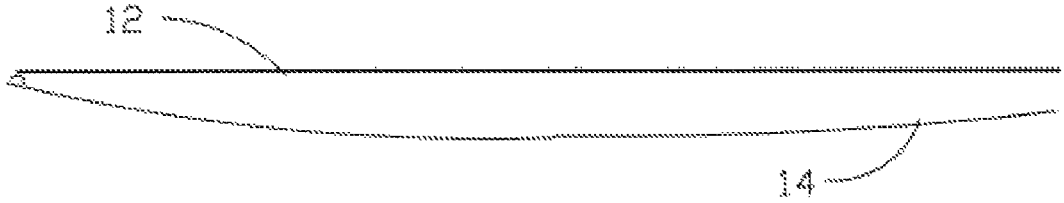

FIG. 6 illustrates asymmetric concave curvature predominating in the left hand neck region, causing the "action" (height between the strings 12 and the fret contour line 14) to be highest in the low pitched region to the left.

Figure 7:
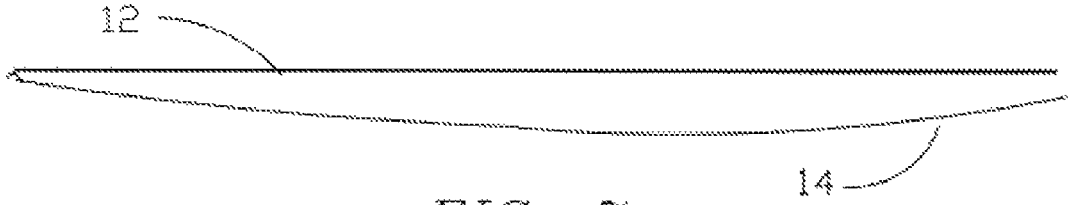

FIG. 7 illustrates asymmetric concave curvature, predominating in the right hand neck region, causing the "action" (height between the strings 12 and the fret contour line 14) to be highest in the high pitched region to the right.

Figure 8:
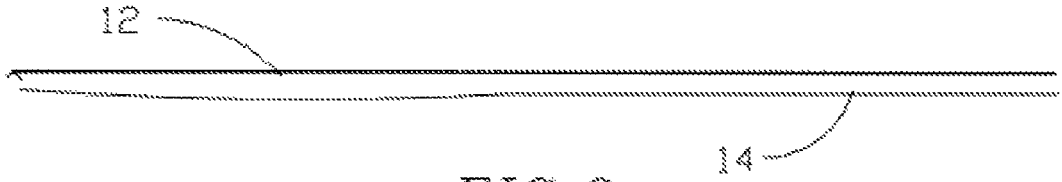

FIG. 8 illustrates a desired "relief" spacing pattern, between the strings 12 and the fret contour line 14, that can be attained by independent adjustment of each portion of the dual tensioned truss structure of present invention acting on concave neck conditions such as shown in FIGS. 5-7. The "relief" pattern is characterized by a small predetermined amount of concave curvature in the low pitched region to the left along with a straighter profile in the high pitched region to the right, as shown.

Figure 9:
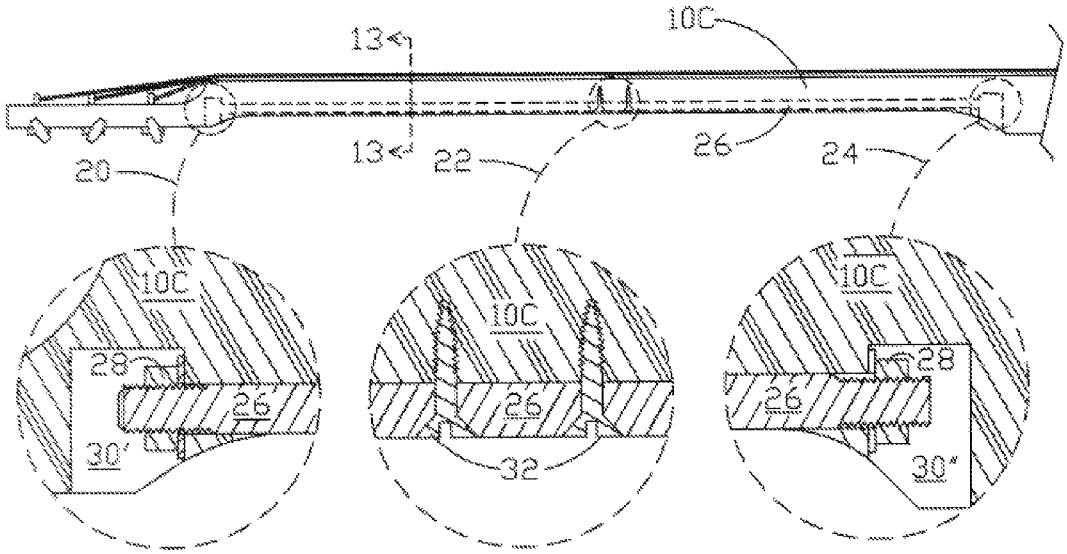
FIG. 9 is a side view of an instrument neck equipped with a truss system of the present invention utilizing a single truss member deployed in an in-line dual-truss mode, with three circled regions shown as enlarged central views taken through a central axis of the neck, at a mid-region and at the two truss-end regions.

FIG. 9 is a side view of an instrument neck 10C equipped with a truss system of the present invention showing enlarged central cross-sectional views at a mid-region and the two end regions of the truss member 26, typically made square in cross-section and located in a close-fitting longitudinal channel machined in the rear side of neck 10C, as shown.

The enlarged cross-section 22 at the mid-region of neck 10C shows truss member 26 anchored to neck 10C by a pair of screw fasteners 32 with flat countersunk heads. Screw clearance holes are made sufficiently tight to prevent any shifting of the truss member 26 especially in the longitudinal direction.

The enlarged views 20 and 24 of the end regions of neck 10C show machine nuts 28 engaging both externally-threaded ends of the one-piece dual truss member 26. Thrust cavities 30' and 30" are configured in neck 10C enclosing nuts 28, and are shaped and dimensioned to allow the use of a wrench to rotate the nuts 28 for adjusting the tension independently in each of the two working portions of truss member 26.

Figure 10:
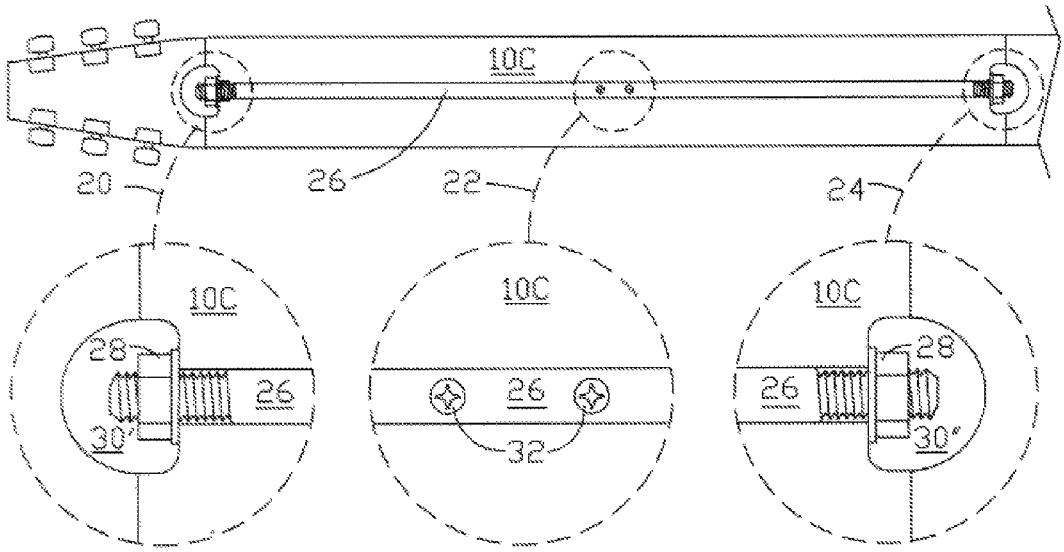
FIG. 10 is a bottom view showing the rear side of the neck and truss system shown in FIG. 9, with three circled regions showing shown as enlarged rear views at the mid-region and at the two truss-end regions.

FIG. 10 is a bottom view of the rear of instrument neck 10C and truss system of FIG. 9. The circled enlarged view 22 of the central region shows the flat heads of screws 32 anchoring truss member 26 to neck 10C. The circled enlarged views 20 and 24 of the two end regions show cavities 30' and 30" configured to enclose nuts 28 and to provide access for adjustment thereof. Preferably nuts 28 should be fitted with rectangular metal pressure plates or equivalent, located to bear against the nuts 28 as shown in the circled enlargements of FIGS. 9 and 10, to enhance the distribution of compressive force against a flat pressure-bearing surface at the innermost side of each truss-end cavity.

Figure 11A:
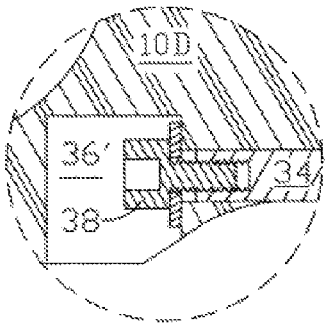
FIGS. 11A-11C are enlarged views and the two truss-end regions, generally as in FIG. 9, but showing an embodiment of the invention utilizing two separate in-line truss members with adjustable threaded fastenings at each outer end.
Figure 11B:
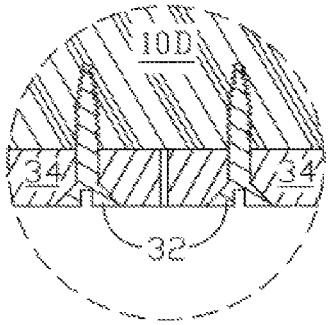
Figure 11C:
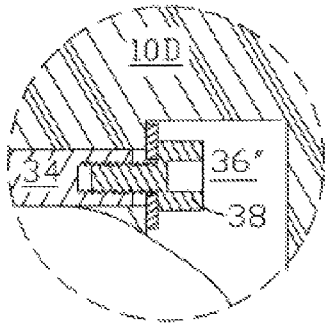

FIGS. 11A-11C are enlarged central cross-sectional views taken at a mid-region and at the two truss-end cavity regions, generally corresponding to the enlarged regions shown in FIG. 9. but showing an equivalent embodiment of the invention wherein the truss system is implemented as two separate in-line truss members 34 and utilizing a different central anchoring system.

FIGS. 11A and 11C show the adjustable tensioning members at the outer truss ends implemented in this dual-truss-member embodiment by a pair of machine screws 38, each located in a corresponding one of the opposite end neck cavities 36' and 36" and each engaging an internally-threaded end of the corresponding one of the two truss members 34. As in FIGS. 9 and 10, preferably screws 38 should be fitted with a rectangular pressure plate or equivalent, as shown, to distribute the compressive force from screw 38 against the pressure-bearing surface at the innermost side of each truss-end cavity of the neck 10C. Screws 38 are of the socket head type, e.g. Allen hex type, that can be rotated for adjustment by a corresponding conventional hand-operated driver tool, engaged in a screw 38 and manipulated within the bounds of cavities 36' and 36".

FIG. 11B shows, in the cross-portion of the central region, the slightly separated central ends of the two truss members 34. A flat head screw 32, traversing each of the truss members 34, engaging neck 10D as shown, acts primarily to retain these end regions of truss members 34 in place in the neck channel, and helps ensure anchoring stability.

Figure 12A:
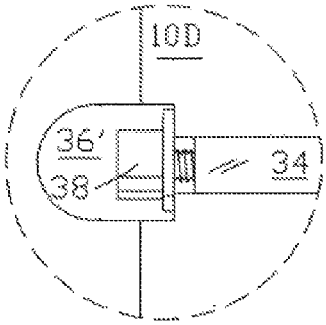
FIGS. 12A-12C are enlarged cross-sections of three regions of the neck, generally as in FIG. 10, but relating to the truss embodiment of FIGS. 11A-11C respectively, and showing, in the central region, each truss end anchored to the neck by a bilateral anchoring structure.
Figure 12B:
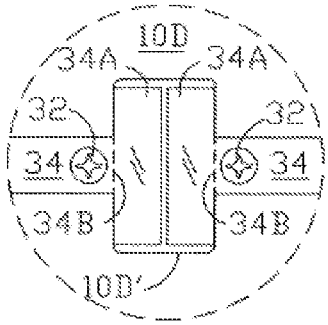
Figure 12C:
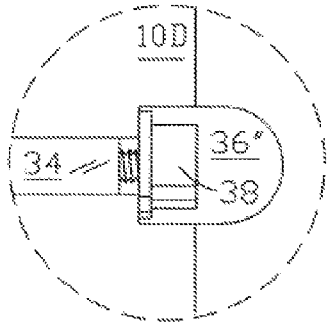

FIGS. 12A-12C are enlarged bottom views taken from the same rear viewpoint as in FIG. 10, showing truss members 34 in the dual-truss-member embodiment of FIGS. 11A-11C respectively.

FIGS. 12A and 12C show the truss-end cavities 36' and 36" in neck 10D containing the two opposite truss-end tensioning members: machine screws 38 engaged in corresponding internally threaded ends of truss members 34.

FIG. 12B shows, in the rear view of the central region of neck 10D, a neck cavity 10D' containing the adjacent ends of truss members 34, each anchored to the designated central region of neck 10D by an anchoring cross-member 34A, extending laterally from the end of truss member 34, forming a "T" shape. Cross-members 34A may each be made from a length of the same material as truss members 34, or other equivalent material, and securely attached to the ends of truss members 34 by fastening such as welding at the interface 34B. Anchoring stability is assisted by screws 32, head view shown, traversing truss members 34 and engaging neck 10D; in this embodiment the primary function of screws 32 is to prevent the truss members 34 from moving out of place in the neck channel.

Alternative approaches to central anchoring could include one or more anchoring members made to extend from the truss-end in any direction, e.g. a pin or rod traversing a hold in the truss member and extending unilaterally or bilaterally. With a suitable grade of metal, the truss member could be made in one piece with the cross-member by splitting an end portion of the truss member and then forming the T shape by bending the two halves of the split portion perpendicular in opposite directions.

Figure 13:
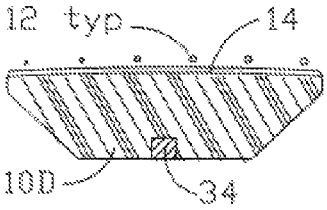
FIG. 13 is a cross-sectional view at axis 13-13 of FIG. 9, in an instrument neck embodiment of the present invention wherein the truss member is located in a rear channel with the rear truss surface exposed, flush with the rear neck surface.

FIG. 13 is a cross-sectional view taken across a region of a neck 10D, e.g. at axis 13-13 located as indicated in FIG. 9. In this embodiment of the invention, the truss member 34 is located in a channel at the rear of neck 10D with an exposed surface made to be flush with the rear surface of the neck 10D, and thus made to feel smooth to the player's touch.

Figure 14:
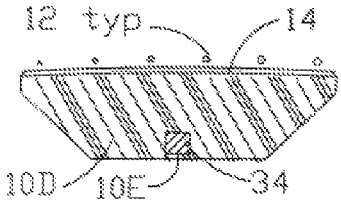
FIG. 14 is a view generally as in FIG. 13 but showing the truss member located in a rear-located channel, but spaced inwardly and concealed by a trim strip.

FIG. 14 is a view generally as in FIG. 13 but showing an alternative embodiment wherein the truss portion/member, e.g. truss member 34, is located offset inwardly from the rear surface of neck 10D and is preferably enclosed and concealed by an inset trim strip 10E with its rear surface made flush with the rear surface of the neck, e.g. neck 10D, so as to feel smooth to the player's touch.

Figure 15:
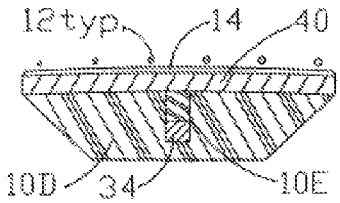
FIG. 15 is a view generally as in FIGS. 13 and 14 but showing the truss member located in a channel that extends to the underside of a fretboard/fingerboard attached to the front side of the neck.

FIG. 15 is a view generally as in FIGS. 13 and 14 but showing a popular type of neck structure wherein the rear surface of the neck 10D is kept intact by locating truss members 34 full depth in a channel that extends to the front side of the neck 10D including adjustment and/or anchoring cavities, where an attached fingerboard or a fretboard 40 carrying fret(s) 14 covers the channels. Unused channel space is preferably occupied by a filler member 10E of suitable material.

The principles of the present invention may be practiced with the truss members having cross sectional shapes other than the square shape shown: the shape could be rectangular or polygonal with any number of sides, it could elliptical including circular. Since the truss member functions in tension only, it could be in the form of a stranded cable, e.g. of stainless steel, utilizing crimped or swaged fastening hardware such as used on sailboat shrouds.

As an alternative to making the two independently adjustable portions of the truss substantially equal in length as described herein in connection with preferred embodiments, the invention could be practiced with the two portions made substantially different in length.

This invention may be embodied and practiced in other specific forms without departing from the spirit and essential characteristics thereof. The present embodiments therefore are considered in all respects as illustrative and not restrictive. The scope of the invention is indicated by the appended claims rather than by the foregoing description. All variations, substitutions, and changes that come within the meaning and range of equivalency of the claims therefore are intended to be embraced therein.

What is claimed is:

1. A truss system, in a stringed musical instrument having a fretboard/fingerboard located on a front side of a neck, for providing adjustable tension independently in each of two different longitudinal portions of said truss system for counteracting concave curvature in each of two corresponding longitudinal portions of the neck, comprising:

first and second truss portions of said truss system, located in at least one channel configured generally in a rear region of the neck opposite the front side and oriented generally parallel with the neck;

fixed truss fastening means made and arranged to strongly secure a central region of said truss system to a designated fastening location in a generally central region of the neck, in a manner particularly secure against longitudinal displacement, said truss portions extending therefrom to respective truss ends located in opposite end regions of the neck; and dual adjustable truss tensioning means, located at respective outer end regions of said first and second truss portions, made and arranged to enable manual application and adjustment of tension in each truss portion independently so as to apply and adjust a compressive force to each neck portion that acts in opposition to concave curvature independently in each of two in-line regions of the neck.

2. The truss system as defined in claim 1 wherein each of said first and second truss portions is made generally rectangular in cross-sectional shape, thus having a flat bottom surface.

3. The truss system as defined in claim 2 wherein each of said first and second truss portions is made generally square in cross-sectional shape.

4. The truss system as defined in claim 1 wherein each of said first and second truss portions constitutes a respective portion of a single full length truss member disposed and located within a truss channel configured lengthwise in a rear region of the neck, extending substantially full length of the neck.

5. The truss system as defined in claim 1 wherein each of said first and second truss portions is located within at least one truss channel configured lengthwise in a rear region of the neck.

6. The truss system as defined in claim 1 wherein said fixed truss fastening means comprises:

at least one fastener device traversing a tight-fitting through-truss opening and engaging the neck at the designated fastening location.

7. The truss system as defined in claim 4 wherein the said fixed truss fastening means comprises:

at least one fastener device traversing a tight-fitting opening in said single truss member and engaging the neck at the designated fastening location.

8. The truss system as defined in claim 1 wherein said dual adjustable truss tensioning means comprises:

each said truss portion being threaded at the outer end region thereof;

a pair of threaded fasteners, each threadedly engaged with a corresponding one of the threaded truss ends; and a pair of pressure-bearing surfaces in respective cavities configured in opposite end regions of the neck near the rear side thereof, each pressure-bearing surface made to receive compressive force from a corresponding one of the threaded fasteners in reaction to tensile force set up in the corresponding portion of the truss member when the corresponding threaded fastener is tightened to bear against the pressure-bearing surface, causing a longitudinal compressive force to be applied to a corresponding rearward neck portion, acting in a direction to reduce concave curvature in the corresponding neck region.

9. The truss system as defined in claim 8 wherein:

said single truss member is externally threaded, at least at one end thereof; and at least one of said pair of threaded fasteners is a machine nut made to each threadedly engage the externally threaded truss end.

10. The truss system as defined in claim 8 wherein:

said single truss member is internally threaded in a central bore, in at least at one of the opposite truss ends; and at least one of said pair of threaded fasteners is a machine screw made to threadedly engage the internally threaded truss end.

11. The truss system as defined in claim 8 further comprising:

said neck being configured with a cavity at each truss end having a boundary encompassing a corresponding pressure-bearing surface, the cavity being made to provide a rear neck opening dimensioned to accommodate a tool for engaging and adjusting an associated threaded fastener contained therein, bearing against the corresponding pressure-bearing surface.

12. The truss system as defined in claim 1 wherein said first and second neck portions are made substantially equal in length, extending from the designated truss-to-neck fastening location to corresponding opposite neck-end regions, thus enabling each half portion of the neck to be independently adjusted to counteract concave curvature.

13. The truss system as defined in claim 1 wherein said truss member is made to have a shape selected from a group that includes elliptical including round, rectangular oriented vertically, rectangular oriented horizontally, D-shaped, and polygonal including triangular and square.

14. A truss system, in a stringed musical instrument having a fretboard/fingerboard located on a front side of a neck, for applying and adjusting compressive force in each of two in-line neck portions in a rear region of the neck for independently counteracting concave neck curvature in each neck portion, comprising:

a truss member located generally in the rear region of the neck opposite the front side and oriented generally parallel with the neck, extending substantially full length of the neck and fastened to the neck at a designated fastening location in a generally central rear neck region, in a secure manner to prevent longitudinal displacement, thus dividing said truss member into two independent truss portions, each extending to respective opposite ends of said truss member; and two threaded tensioning members, each engaging a threaded portion of a corresponding one of the opposite ends of said truss member, made and arranged to enable manual application and adjustment of tension in each truss portion independently and to thus apply and adjust a resultant compressive force in each neck portion in a manner that counteracts concave curvature in each neck portion independently.

* * * * *